US008388077B2

(12) United States Patent
Park

(10) Patent No.: US 8,388,077 B2
(45) Date of Patent: Mar. 5, 2013

(54) REFRIGERATOR AND HINGE ASSEMBLY OF THE SAME

(75) Inventor: Sung Jin Park, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 534 days.

(21) Appl. No.: 12/667,248

(22) PCT Filed: Jan. 8, 2009

(86) PCT No.: PCT/KR2009/000111
§ 371 (c)(1),
(2), (4) Date: Dec. 30, 2009

(87) PCT Pub. No.: WO2009/123393
PCT Pub. Date: Oct. 8, 2009

(65) Prior Publication Data

US 2011/0001413 A1 Jan. 6, 2011

(30) Foreign Application Priority Data

Apr. 2, 2008 (KR) ..... 10-2008-0030693

(51) Int. Cl.
*A47B 96/04* (2006.01)

(52) U.S. Cl. ..... 312/405; 312/326; 16/244

(58) Field of Classification Search ..... 312/405, 312/326, 329; 49/381, 396; 16/243–244
See application file for complete search history.

(56) References Cited

U.S. PATENT DOCUMENTS

| | | | | | |
|---|---|---|---|---|---|
| 1,345,294 | A * | 6/1920 | Van Meter | 16/19 |
| 2,987,755 | A * | 6/1961 | Ferguson | 16/244 |
| 3,662,493 | A * | 5/1972 | Foltz | 49/388 |
| 4,696,078 | A * | 9/1987 | Stromquist | 16/301 |
| 5,054,163 | A * | 10/1991 | Sterling et al. | 16/244 |
| 5,333,355 | A * | 8/1994 | Beswick et al. | 16/300 |
| 5,495,639 | A * | 3/1996 | Wartian | 16/79 |
| 5,694,665 | A * | 12/1997 | Strickland et al. | 16/238 |
| 5,788,351 | A * | 8/1998 | Prunty et al. | 312/326 |
| 5,960,518 | A | 10/1999 | Jeong | |
| 8,166,611 | B2 * | 5/2012 | Moon | 16/240 |
| 2005/0262663 | A1 * | 12/2005 | Lee | 16/221 |
| 2008/0201902 | A1 * | 8/2008 | Moon et al. | 16/244 |

FOREIGN PATENT DOCUMENTS

| | | | |
|---|---|---|---|
| JP | 8296952 | | 11/1996 |
| JP | 2960663 | | 7/1999 |
| KR | 10-2000-0031356 | A | 6/2000 |
| KR | 10-2005-0095265 | | 9/2005 |
| KR | 10-2006-0133196 | A | 12/2006 |

OTHER PUBLICATIONS

Korean Notice of Allowance dated Jun. 5, 2009 for Application No. 10-2008-0030693 with English translation, 3 pages.
International Search Report issued in International Application No. PCT/KR2009/000111, mailed Aug. 25, 2009, 2 pages.

* cited by examiner

*Primary Examiner* — Hanh V Tran
(74) *Attorney, Agent, or Firm* — Fish & Richardson P.C.

(57) ABSTRACT

The present embodiment provides a hinge assembly of a refrigerator. The hinge assembly includes a bracket; a shaft rotatably supported by the bracket and providing a rotation center of a door; a transfer unit transferring selectively rotatory power of the door to the shaft in order to move the shaft upward and downward; and an operating unit operating the transfer unit.

20 Claims, 4 Drawing Sheets

REFRIGERATOR AND HINGE ASSEMBLY OF THE SAME

TECHNICAL FIELD

The present embodiment relates to a refrigerator and a hinge assembly of the same.

BACKGROUND ART

A refrigerator is an apparatus storing for foods at a low temperature. The refrigerator includes a main body in which a storage chamber is formed and a door coupled movably to the main body to open/close the storage chamber. The door is, for example, coupled rotatably to the main body by a hinge assembly.

DISCLOSURE OF INVENTION

Technical Problem

An object of the present embodiment is to provide a refrigerator which easily adjusts the height of its door and a hinge assembly of the same.

Technical Solution

According to one aspect of the present embodiment, there is provided a hinge assembly of a refrigerator comprising: a bracket; a shaft rotatably supported by the bracket and providing a rotation center of a door; a transfer unit transferring selectively rotatory power of the door to the shaft in order to move the shaft upward and downward; and an operating unit operating the transfer unit.

According to another aspect of the present embodiment, there is provided a refrigerator comprising: a main body in which a storage chamber is formed; a door opening/closing the storage chamber; and a hinge assembly allowing the door to be rotatably connected to the body, wherein the hinge assembly comprises: a transfer unit transferring rotatory power selectively to the door; and a shaft providing a rotation center of the door and movable upward and downward with respect to the body by the rotatory power of the door transferred by the transfer unit.

Advantageous Effects

With the proposed embodiment, the present embodiment is advantageous in that a user can adjust the height of a door by moving the door upward and downward.

Also, the present embodiment is advantageous in that the height of the door can be adjusted by rotating the door in both directions in a state where an operating unit is operated so that user's convenience can be improved and the height of the door can be stably adjusted by the user.

BRIEF DESCRIPTION OF THE DRAWINGS

The above and other objects, features and advantages of the present embodiment will become apparent from the following description of preferred embodiments given in conjunction with the accompanying drawings, in which.

MODE FOR THE INVENTION

Hereinafter, embodiments will be described in detail with reference to the accompanying drawings.

Figure 1:
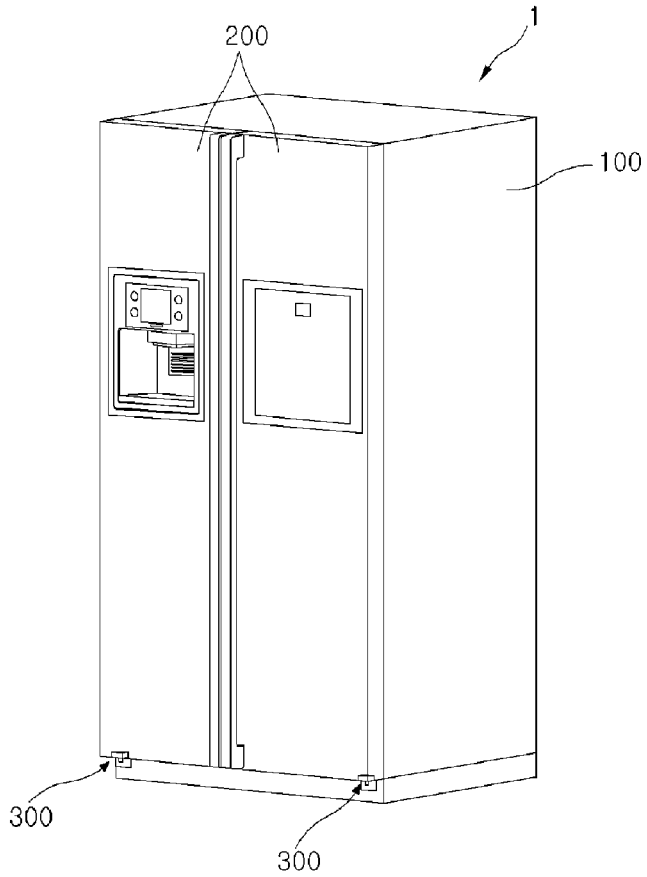
FIG. 1 is a front view of a refrigerator according to a first embodiment.

FIG. 1 is a front view of a refrigerator according to a first embodiment.

In FIG. 1, a side-by-side type refrigerator in which a refrigerating chamber and a freezing chamber are arranged side by side is illustrated. However, the idea of the present embodiment is not limited to the sort of refrigerator but is able to be applied to a top-mount type refrigerator in which a freezing chamber is formed on the top of a refrigerating chamber or a bottom-freezer type refrigerator in which a freezing chamber is formed on the bottom of a refrigerating chamber.

The idea of the present embodiment can also be applied to a refrigerator in which only any one of a freezing chamber and a refrigerating chamber is formed.

Referring to FIG. 1, the refrigerator 1 according to the present embodiment includes a main body 100 in which one or more storage chamber is formed, one or more door 200 opening/closing the storage chamber, and door hinge assemblies 300 (hereinafter, referred to as "hinge assembly") allowing the door to be rotatably connected to the main body.

A plurality of doors 200 may be provided and they may be arranged side by side in view of the front of the refrigerator 1.

The hinge assembly 300 is provided at least on the lower part of the door 200 to support the door 200, wherein the height thereof is adjusted, for example, to allow the height of the lower surface of the door for a bottom surface to be adjusted.

The hinge assembly 300 may also be provided on the upper side of the door 200, or may also be provided on the upper side and the lower side of the door 200, respectively.

Figure 2:
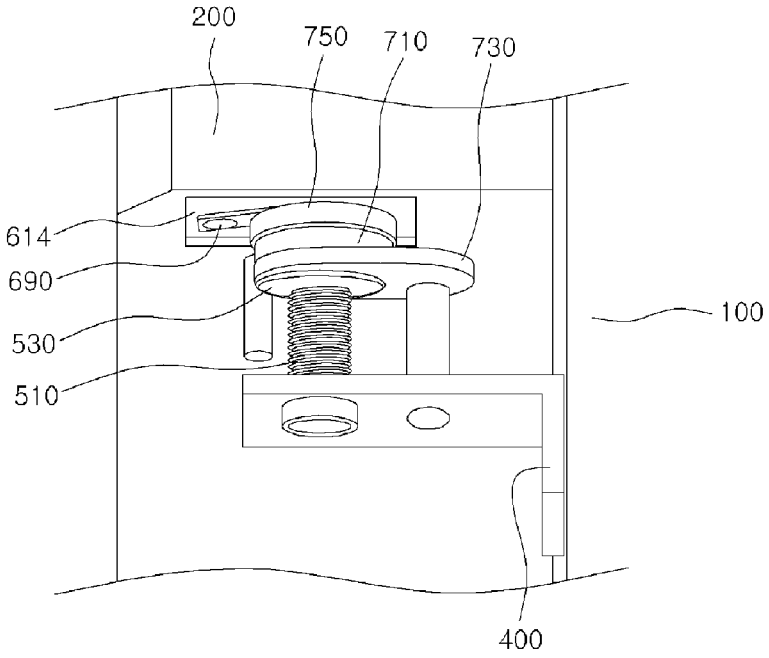
FIG. 2 is a perspective view showing a structure that a hinge assembly is mounted to a door according to a first embodiment.
Figure 3:
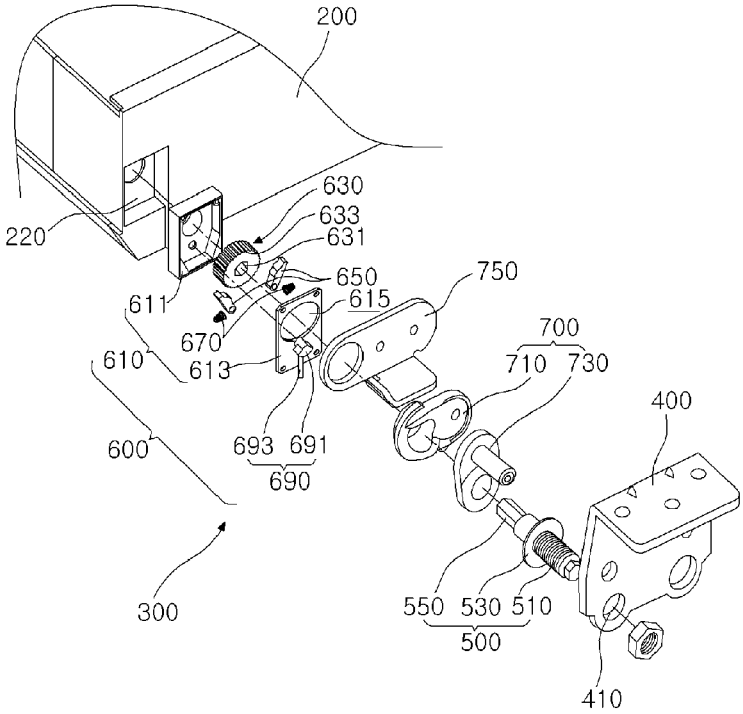
FIG. 3 is an exploded perspective view of a hinge assembly according to a first embodiment.

FIG. 2 is a perspective view showing a structure that a hinge assembly is mounted to a door according to a first embodiment, and FIG. 3 is an exploded perspective view of a hinge assembly according to a first embodiment.

Referring to FIGS. 2 and 3, the hinge assembly 300 includes a bracket 400, a shaft 500, and a transfer unit 600.

The bracket 400 is coupled to the main body 100 at a position spaced from the lower end of the door 200.

The bracket 400 supports the load of the door 200 and is bent in an approximate "ㄱ" shape. The shaft 500 is mounted to the bracket 400.

A receiving part 220 for receiving the transfer unit 600 is formed on the lower side of the door 200. The transfer unit 600 transfers rotatory power of the door 200 to the shaft 500 to allow the shaft to be rotated with the door 200.

The transfer unit 600 includes a case 610 formed having a shape corresponding to that of the receiving part 200, a rotating member 630 received in the inner side of the case 610, a plurality of levers 650 selectively contacted to the rotating member 630, and a plurality of elastic members 670 elastically supporting the respective levers. The plurality of levers 650 are operated by an operating unit 690.

The shaft 500 provides a rotation center of the door 200. The shaft 500 and the bracket 400 are coupled to each other in a screw coupling method.

More specifically, a thread is formed on an outer circumferential surface of the shaft 500. A shaft hole 410 through which the shaft 510 passes is formed on the bracket 410, wherein a thread for being engaged with the thread of the shaft 500 is formed on the inner circumferential surface of the shaft hole 410. Therefore, if the shaft 500 rotates, the shaft 500 moves upward and downward against the bracket 400.

A coupling part 510 in which the thread is formed is formed on the lower side of the shaft 500. The coupling part 510 selectively rotates in a state where it is coupled to the bracket 400. And, the up and down movement distance of the shaft 610 may be the same as the length of the coupling part 510.

A supporting part 530 is formed on the circumference of the shaft 500 corresponding to the upper end of the coupling part 510. The supporting part 530 supports the door 200, and is extended outwardly from the circumference of the shaft 500.

The supporting part 530 is constituted to contact the lower surface of the door 200 or an auto-closing means to be described later.

A coupling part 550 is formed on the upper side of the shaft 500. The coupling part 550 penetrates through the rotating member 630 constituting the transfer unit 600. The cross-section of the coupling part 550 may be formed in a polygonal shape so that the coupling part 550 rotate together with the rotating member 630 in a state that it is coupled to the rotating member 630.

The coupling part 550 is inserted into an inner side of the case 610, and is coupled to the rotating member 630 in the inner side of the case 610.

Meanwhile, a spacer 750 closely adhered to the lower surface of the door 200 and an auto-closing means 700 is provided between the case 610 and the bracket 400. The shaft 500 penetrates through the spacer 750 and the auto-closing means 700.

The spacer 750 is closely adhered to the lower surface of the door 200 to support the lower surface of the door 200, and to prevent the shaking of the shaft 500.

The auto-closing means 700 includes an upper member 710 and a lower member 730. The upper member 710 and the lower member 730 are formed in a cam profile corresponding to each other in a partial section of the contact surface thereof so that they slidingly rotates when the door 200 is closed to allow the door 200 to be closed more smoothly.

The spacer 750 and the auto-closing means 700 are the same as those adopted to a door hinge of a general refrigerator, such that the detailed description thereof will be omitted.

Figure 4:
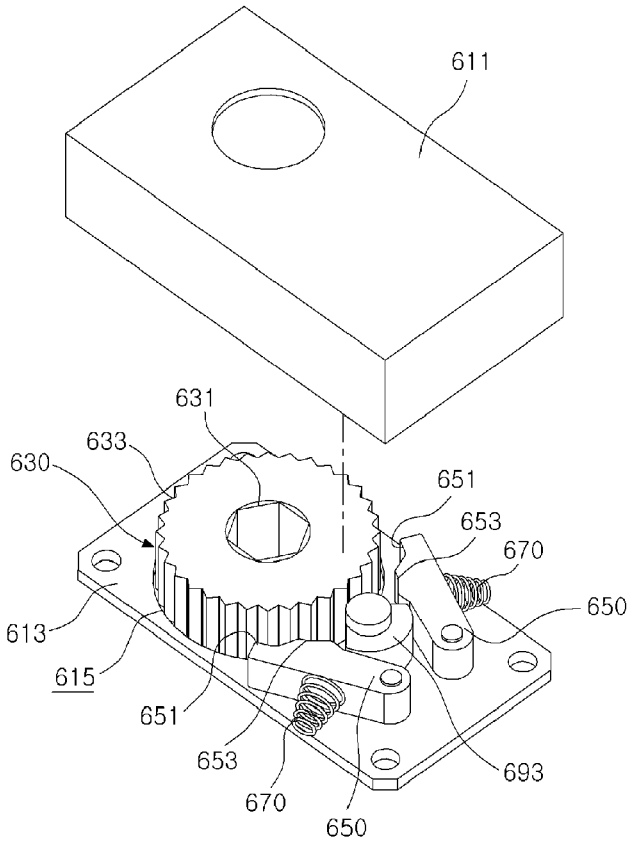
FIG. 4 is an exploded perspective view of a transfer unit according to a first embodiment.
Figure 5:
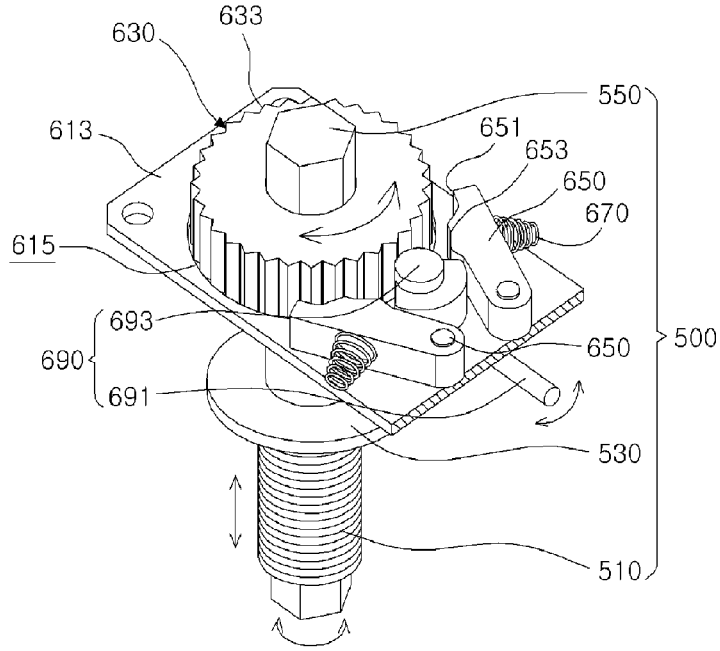
FIG. 5 is a perspective view showing a structure that a transfer unit is coupled to a shaft according to a first embodiment.

FIG. 4 is an exploded perspective view of a transfer unit according to a first embodiment, and FIG. 5 is a perspective view showing a structure that a transfer unit is coupled to a shaft according to a first embodiment.

Referring to FIGS. 4 and 5, the case 610 includes a cover 611 and a base 613.

The cover 611 is formed in an hexahedral shape and includes an lower opening. The cover 611 is received in an inner side of the receiving part 220. The base 613 covers the lower opening of the cover 611 and has an inserting hole 615 into which the rotating member 630 is inserted.

At this time, the base 613 can be positioned on the same plane as the lower surface of the door 200 in a state where the base 613 covers the lower surface of the cover 611.

A coupling hole 631 through which a coupling part 550 of the shaft 500 is penetrated and coupled is formed in the center of the rotating member 630.

Gear teeth 633 are continuously formed on the outer circumferential surface of the rotating member 630. The gear teeth 633 of the rotating member 630 are formed to have the same angle of the inclined planes. The rotating member 630 selectively contacts any one of the plurality of levers 650 to forward-rotate or reverse-rotate together with the shaft 500.

The external diameter of the rotating member 630 is formed to be smaller than the diameter of the inserting hole 615. Therefore, the rotating member 630 can be easily inserted into the inside of the case 610 through the inserting hole 615, and the case 610 can rotate with respect to the rotating member 630 without interference of the rotating member 630 in a general usage state of the door.

The plurality of levers 650 are received in the case 610. Any one of the plurality of levers 650 contacts the gear teeth 633 of the rotating member 630 to allow the rotating member 630 to rotate together with the case 200 in one direction during the process to adjust the height of the door 200.

The plurality of levers 650 may be provided in both sides of an operating part 693 to be described later, respectively. The plurality of levers 650 include a first lever 6501 (see FIG. 6) and a second lever 6502 (see FIG. 6).

The respective levers 650 are hinge-coupled to the base 613 to be rotatable. The other ends of the levers 650 are positioned on both right and left sides of the rotating member 630. In other words, the rotating member 630 and the shaft 500 are positioned between the plurality of levers 650.

Hooking parts 651 are formed on the ends of the levers 650 adjacent to the rotating member 630. The hooking part 651 is formed so that the angle of the edge of the end of the lever 650 corresponds to the angle of the valley between the two adjacent gear teeth 633 formed on the rotating member 630. And, in a state where the hooking part 651 is positioned in the valley of the gear teeth 633, the rotating member 630 rotates with the case when the case 610 rotates in one direction. To the contrary, when the case 610 rotates in other direction, the rotating member 630 maintains a stationary state and the case 610 rotates with respect to the rotating member 630.

A projecting part 563 projected to be inclined at a predetermined angle is formed on the lever 650 to allow unnecessary interference between the lever 650 and the gear teeth 633 not to be generated when the lever 650 rotates.

Hereinafter, a process to adjust the height of the door will be described.

Figure 6:
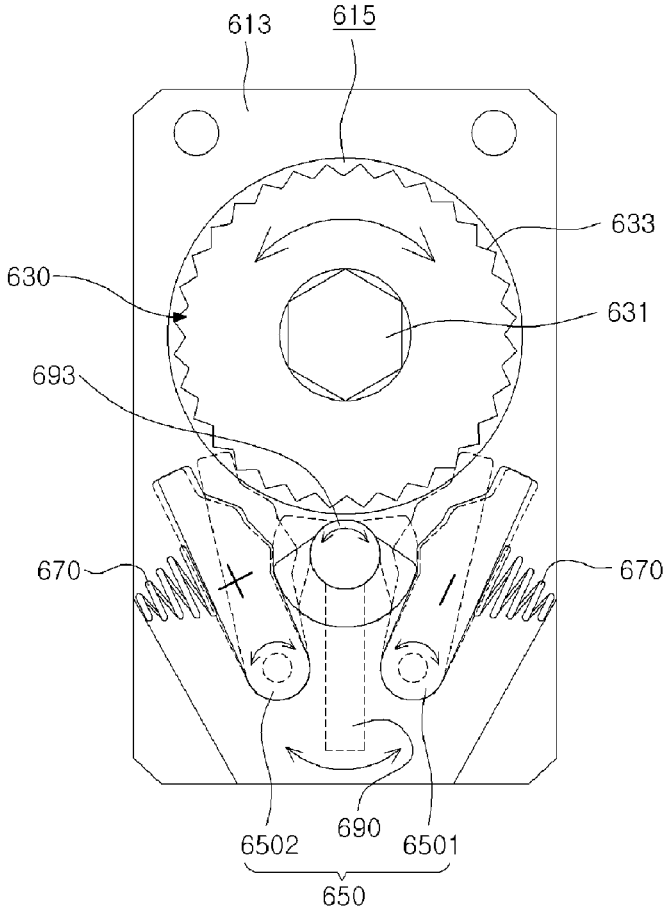
FIG. 6 is an operation state view of a hinge assembly according to a first embodiment.
Figure 7:
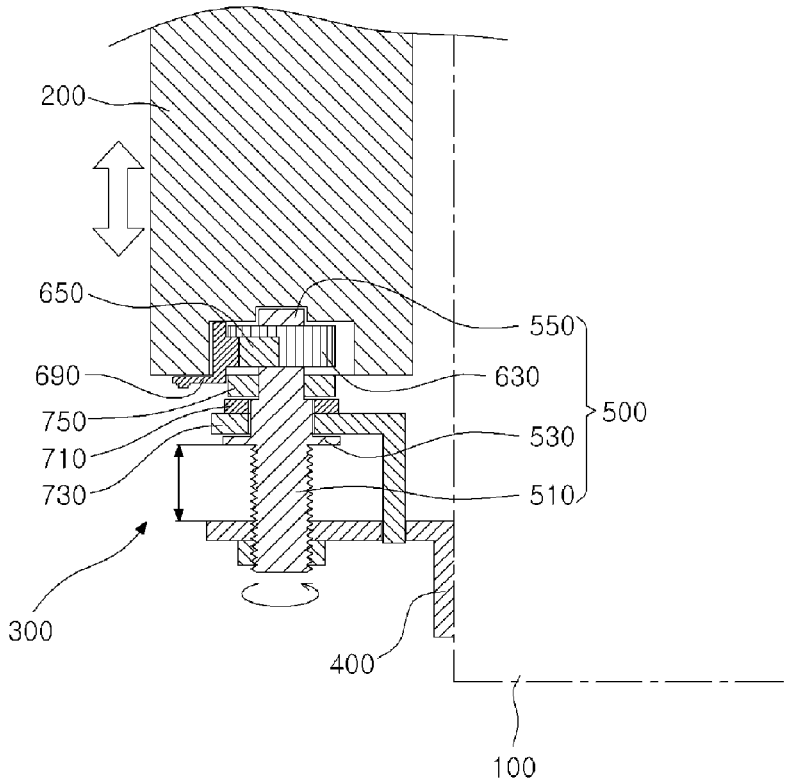
FIG. 7 is a cross-sectional view showing a structure that the height of a door according to a first embodiment is adjusted at maximum.

FIG. 6 is an operation state view of a hinge assembly according to a first embodiment, and FIG. 7 is a cross-sectional view showing a structure that the height of a door according to a first embodiment is adjusted at maximum.

Referring to FIGS. 6 and 7, first, a general usage state of the door will be described.

The general usage state of the door means a state where since the plurality of levers are spaced form the rotating member (a neutral state), the height of the door 200 is not adjusted in spite of the rotation of the door 200.

In a neutral state of the plurality of levers 650, if the door 200 rotates, the case 610 rotates with the door 200, but the shaft and the rotating member 630 maintain a stationary state. In other words, since the plurality of levers 650 are spaced form the rotating member, rotatory power of the door 200 is not transferred to the rotating member so that the rotating member 630 does not rotate.

Meanwhile, when the height of the plurality of doors 200 does not correspond as the refrigerator 1 is re-installed after it is originally installed or it is moved for transfer, or the refrigerator 1 is inclined during the use thereof, a user adjusts the height of the door by rotating the door in which the height adjustment is requested.

First, in order to heighten the door 200, an operating member 691 is rotated in one direction (a clockwise direction, in view of FIG. 6).

Then, the second lever 6502 becomes a state spaced from the rotating member 630, and the first lever 6501 rotates by elasticity to contact the rotating member 630. At this time, a hooking part 651 of the first lever 6501 is inserted into the valley of the gear teeth 633 formed on the rotating member 630.

In the condition as described above, the rotating member rotates only in a counter-clockwise direction, in view of FIG. 6.

In a state where the first lever 6501 contacts the rotating member, if the door 200 rotates on the shaft 500 in a counterclockwise direction in order to open the storage space of the main body 100, the case 610 rotates on the shaft 500 in a counter-clockwise direction (in view of FIG. 6) together with the door. Then, the rotatory power of the door (or case) is transferred to the rotating member 630 so that the rotating member 630 coupled to the shaft 500 rotates in a counterclockwise direction, together with the case 610.

If the shaft 500 rotates in a counterclockwise direction, the shaft 500 moves upwardly in a state where the shaft 500 is coupled to the bracket 400 so that the door moves upwardly. In other words, if the shaft 500 rotates in a counterclockwise direction, the height of the door heightens.

To the contrary, if the door 200 rotates in a clockwise direction in order to close the opened door 200, the case 610 rotates in a clockwise direction in a state where the rotating member 630 is stopped. At this time, the first lever 6501 rotates with the case 610, and the hooking part 651 goes across the gear teeth 631 of the rotating member 630 during the rotation process of the first lever 6501. And, while the hooking part 651 goes across the gear teeth, the elastic member 670 is repeatedly compressed-expanded.

In other words, as the first lever 6501 repeatedly compresses the elastic member 670 when the door 200 is closed, the first lever 6501 is movable along the circumference of the rotating member 630.

The rotatory power of the door is not transferred to the shaft 500 so that only door 200 is rotated in a clockwise direction in a fixed state of the shaft 500.

With the present embodiment as described above, the height of the door can be heighten by repeatedly rotating the door in a clockwise direction and a counter-clockwise direction after the operating unit 690 is operated, such that a user can easily heighten the height of the door.

After adjusting the height of the door 200, the operating member 691 is operated so that the operating member 691 becomes a neutral state. Then, the door 200 can rotate without the change in the height of the door 200.

Meanwhile, in order to lower the height of the door 200, first, the operating member 691 rotates in another direction (in a counterclockwise direction, in view of FIG. 6).

Then, the first lever 6501 becomes a state where it is spaced from the rotating member 630, and the second lever 6502 rotates by elasticity of the elastic member 670 to contact the rotating member 630. At this time, the hooking part 651 of the second lever 6502 is inserted into the valley of the gear teeth 633 formed on the rotating member 630.

In view of FIG. 6, the rotating member 630 in a state as described above rotates only in a clockwise direction.

In a state where the second lever 6502 contacts the rotating member, if the door 200 rotates on the shaft 500 in a counterclockwise direction in order to open the storage space of the main body 100, the case 610 rotates in a counterclockwise direction together with the door.

At this time, the second lever 6502 rotates with the case 610, and the hooking part 651 goes across the gear teeth 631 of the rotating member 630 during the rotation process of the second lever 6502. And, while the hooking part 651 goes across the gear teeth, the elastic member 670 is repeatedly compressed-expanded.

In other words, as the second lever 6502 repeatedly compresses the elastic member 670 when the door 200 is opened, the second lever 6502 is movable along the circumference of the rotating member 630.

The rotatory power of the door 200 is not transferred to the shaft 500 so that only door 200 is rotated in a counterclockwise direction in a fixed state of the shaft 500.

To the contrary, if the door 200 rotates in a clockwise direction in order to close the opened door 200, the case 610 rotates on the shaft 500 in a clockwise direction (in view of FIG. 6). Then, the rotatory power of the door (or case) is transferred to the rotating member 630 so that the rotating member 630 coupled to the shaft 500 rotates in a clockwise direction, together with the case 610.

If the shaft 500 rotates in a clockwise direction, the shaft 500 moves downwardly in a state where the shaft 500 is coupled to the bracket 400 so that the door moves downwardly. In other words, if the shaft 500 rotates in a clockwise direction, the height of the door lowers.

With the present embodiment as described above, the height of the door can be lowered by repeatedly rotating the door in a clockwise direction and a counter-clockwise direction after the operating unit 690 is operated, such that a user can easily lower the height of the door.

After adjusting the height of the door 200, the operating member 691 is operated so that the operating member 691 becomes a neutral state. Then, the door 200 can rotate without the change in the height of the door 200.

Figure 8:
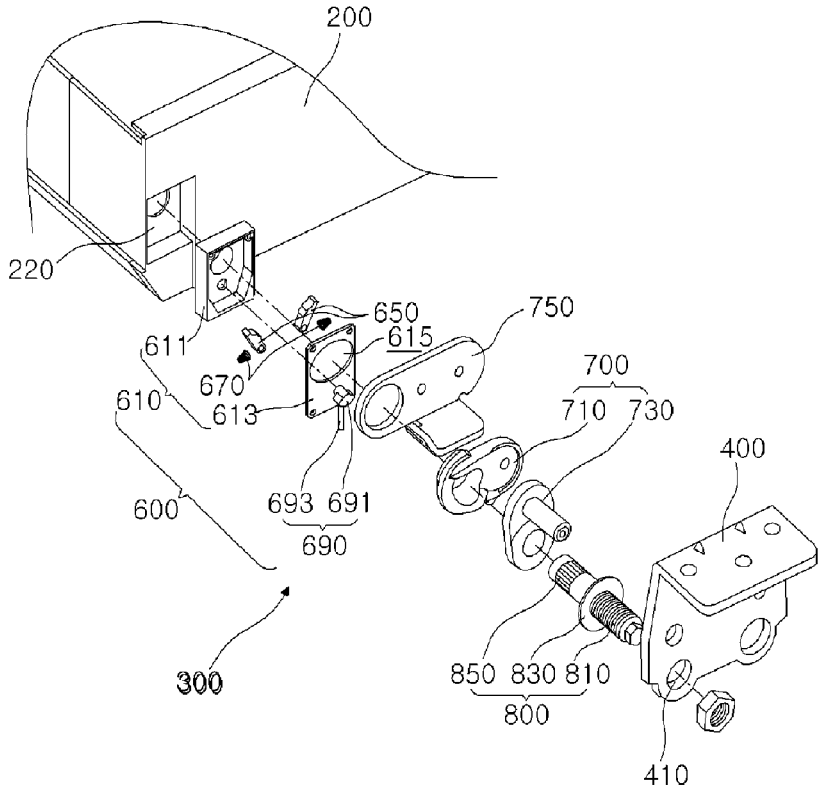
FIG. 8 is an exploded perspective view of a hinge assembly according to a second embodiment.

FIG. 8 is an exploded perspective view of a hinge assembly according to a second embodiment.

The present embodiment is the same as the first embodiment, except for the feature that a shaft selectively contacts any one of a plurality of levers. Therefore, only the features of the present embodiment will be described herein and the first embodiment will be quoted for the same contents as the first embodiment.

Referring to FIG. 8, the shaft 800 according to the embodiment includes a coupling part 810 coupling to the bracket 410, a supporting part supporting the door 200, and a gear part 850 having a circumference along which gear teeth are continuously formed.

The gear part 850 penetrates through the base 613 to be received in the case 610, and selectively contacts the plurality of levers by the operation of the operating unit 690.

In other words, the shaft directly and selectively contacts the plurality of levers, without having the rotating member as shown in the first embodiment.

The acting of the hinge assembly of the present embodiment is the same as the first embodiment, except for the feature that the hinge assembly contacts the gear teeth formed on the shaft 800. Therefore, the detailed description thereof will be omitted.

The invention claimed is:

1. A hinge assembly comprising:

a bracket installed on a main body;

a shaft having a first portion rotatably supported by the bracket and a second portion providing a rotation center of a door that selectively opens and closes the main body;

a transfer unit configured to transfer selectively rotatory power of the door to the shaft in order to move the shaft upward and downward; and an operating unit configured to selectively control the transfer unit by a user, wherein, when the operating unit is operated in a first state, the transfer unit is connected to the bracket and the rotary power of the door is transferred to the shaft to adjust the height of the door, and, when the operating unit is operated in a second state that is different than the first state, the transfer unit is disconnected from the bracket and the rotary power of the door is not transferred to the shaft.

2. The hinge assembly according to claim 1, wherein the transfer unit is connected selectively to the shaft according to the operation direction of the transfer unit.

3. The hinge assembly according to claim 1, wherein the transfer unit includes a plurality of levers moved by the operation of the operating unit and a plurality of elastic members supporting the respective levers.

4. The hinge assembly according to claim 3, further comprising:

a rotating member coupled to the shaft, wherein according to the operation direction of the operating unit, the plurality of levers are spaced from the rotating member, or any one of the plurality of levers is spaced from the rotating member and the other one thereof is contacted to the rotating member.

5. The hinge assembly according to claim 4, wherein when the door rotates in a state where the plurality of levers are spaced from the rotating member, the door rotates with respect to the rotating member, and when the door rotates in a state where any one of the plurality of levers contacts the rotating member, the rotating member rotates with the door.

6. The hinge assembly according to claim 4, wherein a plurality of gear teeth are formed along the circumference of the rotating member, and hooking parts selectively positioned in the valleys formed between adjacent two gear teeth are formed in the respective levers.

7. The hinge assembly according to claim 3, wherein according to the operation direction of the operating unit, the plurality of levers are spaced from the shaft, or any one of the plurality of levers is spaced and the other thereof is contacted to the shaft.

8. The hinge assembly according to claim 7, wherein a plurality of gear teeth are formed along the circumference of the shaft, and hooking parts selectively positioned in the valleys formed between adjacent two gear teeth are formed in the respective levers.

9. A refrigerator comprising:

a main body in which a storage chamber is formed;

a door opening/closing the storage chamber; and a hinge assembly allowing the door to be rotatably connected to the body, wherein the hinge assembly comprises:

a transfer unit transferring rotatory power selectively to the door;

an operating unit configured to operate the transfer unit; and a shaft providing a rotation center of the door and movable upward and downward with respect to the body by the rotatory power of the door transferred by the transfer unit, wherein, when the operating unit is operated in a first state, the transfer unit is connected to the bracket and the rotatory power of the door is transferred to the shaft to adjust the height of the door, and, when the operating unit is operated in a second state that is different than the first state, the transfer unit is disconnected from the bracket and the rotatory power of the door is not transferred to the shaft.

10. The refrigerator according to claim 9, wherein the transfer unit includes a plurality of levers transferring the rotatory power of the door selectively to the shaft, and a plurality of elastic members supporting the respective levers.

11. The refrigerator according to claim 10, wherein the shaft rotates with the door when the door rotates in one direction in a state where any one of the plurality of levers contacts the shaft.

12. The refrigerator according to claim 11, wherein the door rotates with respect to the shaft when the door rotates in the other direction.

13. The refrigerator according to claim 11, wherein the door rotates with respect to the shaft in a state where the plurality of levers are spaced form the shaft.

14. The refrigerator according to claim 10, further comprising:

a rotating member connected to the shaft to be rotatable with the shaft, and connected selectively to the plurality of levers.

15. A hinge assembly of a refrigerator comprising:

a bracket;

a shaft rotatably supported by the bracket and providing a rotation center of a door;

a transfer unit transferring selectively rotatory power of the door to the shaft in order to move the shaft upward and downward; and an operating unit operating the transfer unit, wherein the transfer unit includes a plurality of levers moved by the operation of the operating unit and a plurality of elastic members supporting the respective levers.

16. The hinge assembly according to claim 15, further comprising:

a rotating member coupled to the shaft, wherein according to the operation direction of the operating unit, the plurality of levers are spaced from the rotating member, or any one of the plurality of levers is spaced from the rotating member and the other one thereof is contacted to the rotating member.

17. The hinge assembly according to claim 16, wherein when the door rotates in a state where the plurality of levers are spaced from the rotating member, the door rotates with respect to the rotating member, and when the door rotates in a state where any one of the plurality of levers contacts the rotating member, the rotating member rotates with the door.

18. The hinge assembly according to claim 16, wherein a plurality of gear teeth are formed along the circumference of the rotating member, and hooking parts selectively positioned in the valleys formed between adjacent two gear teeth are formed in the respective levers.

19. The hinge assembly according to claim 15, wherein according to the operation direction of the operating unit, the plurality of levers are spaced from the shaft, or any one of the plurality of levers is spaced and the other thereof is contacted to the shaft.

20. The hinge assembly according to claim 19, wherein a plurality of gear teeth are formed along the circumference of the shaft, and hooking parts selectively positioned in the valleys formed between adjacent two gear teeth are formed in the respective levers.

* * * * *